US005777188A

United States Patent [19]

Reed et al.

[11] Patent Number: 5,777,188

[45] Date of Patent: Jul. 7, 1998

[54] THERMAL CRACKING PROCESS

[75] Inventors: Larry E. Reed; Kenneth E. Inkrott; James E. Shaw, all of Bartlesville, Okla.

[73] Assignee: Phillips Petroleum Company, Bartlesville, Okla.

[21] Appl. No.: 656,571

[22] Filed: May 31, 1996

[51] Int. Cl.[6] ..... C07C 4/02; C07C 7/10; C07C 7/17; C10G 9/12

[52] U.S. Cl. ..... 585/648; 585/649; 585/653; 585/833; 585/856; 585/950; 208/48 AA; 208/48 R

[58] Field of Search ..... 585/648, 653, 585/833, 856, 950, 649; 208/48 AA, 48 R, 106

[56] References Cited

U.S. PATENT DOCUMENTS

| | | | |
|---|---|---|---|
| 4,404,087 | 9/1983 | Reed et al. | 208/48 AA |
| 4,404,124 | 9/1983 | Johnson et al. | 252/466 PT |
| 4,410,418 | 10/1983 | Kukes et al. | 208/48 R |
| 4,507,196 | 3/1985 | Reed et al. | 208/48 AA |
| 4,551,227 | 11/1985 | Porter et al. | 208/48 AA |
| 4,552,643 | 11/1985 | Porter et al. | 585/950 |
| 4,725,569 | 2/1988 | Tuszynaski et al. | 502/168 |
| 4,911,825 | 3/1990 | Roussel et al. | 585/843 |
| 5,120,892 | 6/1992 | Skraba | 585/652 |
| 5,264,114 | 11/1993 | Dunbar | 208/48 HA |
| 5,463,159 | 10/1995 | Callejas | 585/648 |
| 5,616,236 | 4/1997 | Brown et al. | 585/648 |
| 5,630,964 | 5/1997 | Babaian-Kibala et al. | 585/950 |

OTHER PUBLICATIONS

Organic Chemistry of Bivalent Sulfur (vol. III, ed. E. Reid, 1960, pp. 369–371 and 391–393) Month N/A.

Chemistry of Organosulfur Compounds (ed. L. Belen'kii, 1990, pp. 51–52) Month N/A.

"Chemistry of Organosulfur Compounds", Belen'kii, L. I. ed., N. D. Zelinsky Institute of Organic Chemistry, USSR Academy of Sciences, Moscow, USSR, pp. 51–52, 1990.

*Primary Examiner*—Glenn Caldarola
*Assistant Examiner*—Patricia L. Hailey
*Attorney, Agent, or Firm*—Lucas K. Shay

[57] ABSTRACT

A thermal cracking process is provided which comprises contacting a thermal cracking furnace with a fluid stream which comprises steam and a polysulfide such as di-t-nonylpolysulfide under a condition sufficient to effect the suppression of the formation of carbon monoxide and thereafter introducing a steam fluid containing a saturated hydrocarbon such as ethane and a polysulfide such as di-t-nonylpolysulfide under a condition sufficient to convert the saturated hydrocarbon to an olefinic compound such as ethylene.

29 Claims, No Drawings

THERMAL CRACKING PROCESS

FIELD OF THE INVENTION

The present invention relates to a process for thermal cracking of a fluid stream containing a hydrocarbon.

BACKGROUND OF THE INVENTION

In a process for producing an olefin compound, a fluid stream containing a saturated hydrocarbon such as ethane, propane, butane, pentane, naphtha, or mixtures of two or more thereof is fed into a thermal (or pyrolytic) cracking furnace. A diluent fluid such as steam is usually combined with the hydrocarbon feed material being introduced into the cracking furnace. Within the furnace, the saturated hydrocarbon is converted into an olefinic compound. For example, an ethane stream introduced into the cracking furnace is converted into ethylene and appreciable amounts of other hydrocarbons. A propane stream introduced into the furnace is converted to ethylene and propylene, and appreciable amounts of other hydrocarbons. Similarly, a mixture of saturated hydrocarbons containing ethane, propane, butane, pentane and naphtha is converted to a mixture of olefinic compounds containing ethylene, propylene, butenes, and pentenes, and aromatic compounds such as naphthalene. Olefinic compounds are an important class of industrial chemicals. For example, ethylene is a monomer or comonomer for making polyethylenes. Other uses of olefinic compounds are well known to those skilled in the art.

As a result of the thermal cracking of a hydrocarbon, the cracked product stream can also contain appreciable quantities of hydrogen, methane, acetylene, carbon monoxide, carbon dioxide, and pyrolytic products other than the olefinic compounds. At the furnace exit, the product stream is cooled to remove the heavier gases.

The carbon monoxide formed during the cracking of a hydrocarbon, if in excess quantity, can have a detrimental effect on downstream treatment process of the desired olefinic compound. For example, ethylene produced by thermal cracking of ethane generally is contaminated with small quantity of acetylene which is usually selectively hydrogenated to ethylene in a hydrogenation reaction. Carbon monoxide in excess quantity has been shown to temporarily poison or inactivate a hydrogenation catalyst and thus significantly cool the temperature of the hydrogenation reactor thereby making the selective hydrogenation of acetylene considerably less effective.

During the thermal cracking process, a semi-pure carbon which is termed "coke" is also formed in the cracking furnace as a result of the furnace cracking operation. Coke is also formed in the heat exchangers used to cool the product stream flowing from the cracking furnace. In order to burn out the deposits of coke, a thermal cracking furnace is required to periodically shut down the furnace resulting in a substantial loss of production. Additionally, coke is a poor heat conductor. As coke is deposited, a higher furnace temperature is required to maintain the saturated hydrocarbon temperature in the cracking zone at a desired level resulting in increased fuel consumption and shorter furnace life.

Therefore, there is an ever-increasing need to improve the thermal cracking process by reducing the formation of carbon monoxide or coke, or both, during the cracking process. It would be a significant contribution to the art if an improved thermal cracking process were developed.

SUMMARY OF THE INVENTION

An object of the invention is to provide a thermal cracking process for pyrolysis of a saturated hydrocarbon. Another object of the invention is to provide a thermal cracking process having low concentration of carbon monoxide formation. A further object of the invention is to provide a thermal cracking process whereby a fluid stream containing an organic polysulfide compound is introduced into the thermal cracking furnace during the startup of the thermal cracking process and, optionally, during the thermal cracking process. Other objects, features, and advantages will become more apparent as the invention is more fully disclosed hereinbelow.

According to a first embodiment of the present invention, a process for startup of a thermal cracking process for converting a saturated hydrocarbon into an olefimic compound is provided which comprises contacting a radiant tube (hereinafter referred to as a cracking tube) of a thermal cracking furnace with a fluid stream which comprises steam and an organic polysulfide compound.

According to a second embodiment of the present invention, a thermal cracking process for converting a saturated hydrocarbon into an olefimic compound is provided which comprises contacting a cracking tube contained in a thermal cracking furnace with a fluid stream which comprises steam and an organic polysulfide compound; and thereafter introducing a second fluid stream which comprises steam, a saturated hydrocarbon, and an organic polysulfide compound into the cracking tubes under conditions sufficiently effective to convert a saturated hydrocarbon into an olefimic compound.

DETAILED DESCRIPTION OF THE INVENTION

As used in the present invention, the term "fluid" denotes gas, liquid, or both. The term "saturated hydrocarbon" is referred to as any saturated hydrocarbon which can be converted to an unsaturated hydrocarbon such as an olefinic compound by a thermal cracking process. An "unsaturated hydrocarbon" as used in this application is a hydrocarbon having at least one double bond between carbon atoms in the molecule. Generally, examples of saturated hydrocarbons include, but are not limited to, ethane, propane, butanes, pentane, naphtha, and combinations of two or more thereof. Examples of unsaturated hydrocarbons include, but are not limited to, olefins such as ethylene, propylene, butenes, and pentenes, aromatic compounds such as naphthalene, and combinations of two or more thereof.

The term "organic polysulfide compounds" (hereinafter referred to as polysulfide) as used herein denotes a compound having the formula of $RS_qR$, wherein each R can be the same or different and are each a hydrocarbyl radical having 1 to about 30, preferably about 1 to about 20, and most preferably 2 to 15 carbon atoms and q is a number from about 3 to about 10, preferably about 3 to about 8, and most preferably 3 to 6. The hydrocarbyl radical can be linear or branched and can be alkyl, aryl, cycloalkyl, alkaryl, aralkyl, alkenyl radicals, or combinations of any two or more thereof. Preferably the hydrocarbyl radical is an alkyl radical.

Examples of suitable polysulfide include, but are not limited to, di-t-butylpolysulfide, di-n-butylpolysulfide, dicyclohexylpolysulfide, dimethylpolysulfide, di-n-nonylpolysulfide, di-t-nonylpolysulfide, di-t-dodecylpolysulfide, di-n-dodecylpolysulfide, and combinations of any two or more thereof. Generally, each molecule of these polysulfides contains different numbers of sulfur atoms per molecule in the range disclosed above. For example, a di-t-dodecylpolysulfide can contain some di-t-dodecyltrisulfides, some di-t-dodecyltetrasulfides, some di-t-dodecylpentasulfides, and some di-t-dodecylhexasulfides.

According to the present invention, a cracking tube of a thermal cracking furnace is contacted with a fluid stream, which comprises steam and a polysulfide under conditions sufficient to reduce the formation of carbon monoxide during a thermal cracking process, before a second fluid stream which comprises a hydrocarbon is introduced into the cracking tube of the cracking furnace for producing an olefinic compound.

The present invention process can be carried out in any suitable thermal cracking furnace known in the art. Examples of such thermal cracking furnace are disclosed in U.S. Pat. Nos. 5,120,892 and 5,264,114, disclosures of which are incorporated herein by reference. Because cracking furnaces are well known to one skilled in the art and the choice of a suitable cracking furnace is generally a matter of preference to one skilled in the art, the description of a suitable thermal cracking furnace is omitted herein for the interest of brevity.

Generally, a fluid stream containing steam and a polysulfide can be introduced into a thermal cracking furnace by any suitable means such as, for example, pressure. Because the means for introducing such fluid stream are well known to one skilled in the art, the description of which is omitted also herein.

Steam is used in the invention as a diluent or carrier for the polysulfide compound, or a hydrocarbon stream. Steam can be generated by any heat exchange means. Stream can also be generated in-situ from liquid water by any known heat exchange means. Any quantity of steam can be used in the present invention as long as the quantity is effective in carrying the various fluids of the invention process. The fluid in the cracking tubes of a cracking furnace can be heated by any heat exchange means from about 1000 ° F. to about 2000° F.

According to the process of the present invention, the fluid stream can also comprise a hydrogen-containing fluid. The hydrogen-containing fluid can be a substantially pure hydrogen. It can also contain other gases such as, for example, nitrogen, methane, carbon dioxide, or mixtures thereof so long as the hydrogen-containing fluid contains at least about 2 mole %, preferably at least about 3 mole %, and most preferably at least 5 mole % of hydrogen. Because the exit fluid stream of the cracking furnace, after the desired olefinic product is recovered, also contains hydrogen within the range disclosed above, it is preferred that this exit fluid stream be recycled and reintroduced into the cracking furnace in the process of the invention. As used herein, unless otherwise indicated, the term "exit fluid" is referred to as a fluid stream which is part of the product stream and which does not include appreciable amounts of the desired olefinic compound products. Sometimes this exit fluid is referred to, in the thermal cracking industry, as tail gas which is also useful as fuel gas. The exit fluid generally comprises about 60 to about 80 mole % of hydrogen, about 20 to about 40 mole % of methane, and about 0.5 to about 3 mole % of ethylene.

Any quantity of hydrogen or hydrogen-containing fluid can be employed in the present invention as long as that quantity can effectively facilitate the suppression of the formation of carbon monoxide or coke, or both. For example, the concentration of hydrogen can be in the range of from about 20 to about 1500 parts hydrogen per million of steam (ppm) by weight, preferably about 30 to about 1000 ppm, and most preferably 50 to 500 ppm.

Similarly, any quantity of polysulfide can be employed in the present invention as long as that quantity can effectively suppress the formation of carbon monoxide or coke, or both, during a thermal cracking process for converting a saturated hydrocarbon to an olefinic compound. Generally, the concentration of the polysulfide can be in the range of from about 20 to about 1500 parts of the polysulfide per million parts of steam (ppm) by weight sulfur, preferably about 30 to about 1000 ppm, and most preferably 50 to 500 ppm.

The time required for the contacting of the cracking tubes of the cracking furnace with the fluid stream can vary widely as long as the formation of carbon monoxide or coke, or both, can be effectively suppressed during a thermal cracking process. The time can be as short as about 5 seconds to as long as about 10 hours, preferably about 10 seconds to about 8 hours, most preferably from 20 seconds to 7 hours.

Although it is not necessary to preheat the cracking tube of the cracking furnace before the cracking tube is contacted with the fluid stream, it is preferred that the cracking tube be heated before contacting the cracking tube with the fluid stream for better cracking results. The furnace can be heated by any heat exchange means known in the art. The cracking furnace can be preheated to the temperature range described above, i.e., about 1000° F. to about 2000° F.

After the cracking tube(s) of the cracking furnace is contacted with a fluid stream which comprises steam and a polysulfide as described above, a second fluid stream comprising a saturated hydrocarbon, a polysulfide and steam can be introduced into the cracking tube of the cracking furnace for converting the saturated hydrocarbon to an olefinic compound. The introduction of the second fluid stream can be carried out by the same means as those described above for introducing the first fluid stream to the cracking tubes of the cracking furnace. See also U.S. Pat. Nos. 5,120,892 and 5,264,114, disclosures of which are herein incorporated by reference.

Any quantity of steam can be used in the second fluid stream so long as the quantity is effective in carrying a saturated hydrocarbon into a thermal cracking furnace. Generally, the weight ratio of steam to a saturated hydrocarbon can be in the range of from about 0.00002:1 to about 1: 1, preferably about 0.002:1 to about 0.75:1, and most preferably 0.0005:1 to 0.5:1. The quantity of a polysulfide can be the same as that disclosed in the first embodiment of the invention.

Once the second fluid stream is introduced into the cracking tubes of the cracking furnace, the cracking reactions can take place at any suitable conditions that provide the necessary cracking to the desired olefinic compound product(s). Generally, the cracking temperature of the furnace can be in a range of from about 1000° F. to about 2000° F., preferably about 1000 ° F. to about 1800° F., and most preferably 1000° F. to 1700° F. A wide range of pressure can be applied to the cracking operation such as, for example, within a range of from about 1 psig to about 100 psig, preferably abut 2 psig to about 75 psig, and most preferably 3 psig to 60 psig, at the outlet of the cracking tube of the cracking furnace. The time required for converting a saturated hydrocarbon to an olefinic compound can vary widely depending on the hydrocarbon used in the process, the olefinic compound(s) desired, and the rate of the introduction of the second fluid stream. Generally, the flow rate of the second fluid stream is in the range of from about 6,000 to about 20,000 pounds per hour per cracking coil depending on the capacity of the cracking furnace. The residence time of the hydrocarbon fluid, based on the rate described above, is generally in the range of from about 0.05 second to about 1 second.

The product stream of the cracking process generally is a fluid stream containing the desired olefinic products such as ethylene, propylene, butenes, and pentenes, and impurities including alkynes such as, for example, acetylene, dienes such as 1,3-butadiene, and acidic compounds such as hydrogen sulfide, carbon dioxide, and carbon monoxide. Other impurities such as olefins higher than 5 carbon atoms and aromatic compounds can also be present in the product stream. Generally, these impurities can range from about 100 parts per million by weight (ppm) to about 4 weight %. These impurities can be removed so as to have a final end product which meets product specifications. These impurities can be removed by any means known to one skilled in the art.

The product stream is generally first cooled by any heat exchange means to a temperature in the range of from about 30° C. to about 300° C. The cooled product stream is fed to a quench means wherein the cooled product stream can be, if desired, contacted with water or a quench solution having a sufficient concentration of, for example, an amine compound to remove some undesired impurities such as, for example, carbonyl compounds to produce a "quenched" product stream. The "quenched" product stream is then generally compressed by a suitable compression means such as a compressor to increase the pressure of the product stream. The product stream is subsequently transferred to a caustic washer wherein a caustic stream is introduced to further remove the acidic by-products such as hydrogen sulfide and carbon dioxide.

Thereafter, the product stream can be further introduced into a hydrogenation reactor whereby any alkynes are selectively hydrogenated to a desired olefinic compound. Thereafter, the concentration of any saturated hydrocarbons such as, for example, methane, ethane, propane, in the product stream can be significantly removed by a means such as demethanization, or deethanization, or depropanization to recover the desired olefinic compounds(s). The remaining fluid stream containing hydrogen is defined as "exit fluid" or "tail gas". Because these processes and means are well known in the art, the description of which is omitted herein for the interest of brevity. See, for example, U.S. Pat. Nos. 4,404,124; 5,120,892, and 5,264,114.

The following examples are presented to further illustrate the present invention and are not intended to unduly limit the scope of the invention.

EXAMPLE I

This example illustrates a commercial process for cracking ethane to ethylene without pretreating the cracking furnace by the process of the invention.

The cracking furnace used has 8 internal coils (1 coil=16 inlet cracking tubes which form 1 outlet tube) and had a total capacity of about 60,000 pounds per hour for ethane/propane mixture at 80 psig. The furnace was heated with fuel gas.

Steam was introduced into the cracking tubes at a rate of 6,000 pounds per coil per hour containing 300 ppm by weight of dimethyl sulfide while the furnace was being heated to 1250° F. The furnace was held at 1250° F. for 4–6 hours. Thereafter, the rate of steam was reduced to 2000 pounds per hour per coil. Ethane was steadily introduced into the steam stream, while the steam rate was reduced to 2000 pounds per hour per coil. The ethane feed rate was increased to 7500 pounds per hour per coil in about 30 minutes. The furnace was heated upwardly to 1600° F. while ethane was being introduced. The process was then steadily run for about 40 days until it was necessary to shut down the operation to remove coke buildup in the coils.

The product stream of the ethane cracking process was cooled to 200° F. using water whereby steam was generated. At this point the carbon monoxide content was measured using an on-line gas chromatograph manufactured by Applied Automation, Inc., Bartlesville, Okla. The initial carbon monoxide content in the product stream, measured by the analytical means in over 100 runs, was in the range of from 3000 ppm to 4000 ppm by weight. Because of the high initial CO content of the product stream, some batches of ethylene produced did not meet product specifications.

EXAMPLE II

This examples demonstrates the suppression of carbon monoxide or coke or both content in an ethane cracking process using the process of the invention.

The runs were carried out in laboratory cracking furnaces each having the following cracking tube (coil) set up: dimensions: 0.25 inch outer diameter (0.18 inch inner diameter)×7.9 foot length and 8.5 inch transfer line connecting coil to quench system; the alloy used was Incoloy 800 H; residence time at cracking conditions was approximately 0.1 second; and the coil is bent into 4 passes and confined within the isothermal region of a three-zone furnace.

Thiophene, di-t-butylpolysulfide (average of 4.5 sulfur atoms per molecule and contained 55.7 weight % S), and di-t-nonylpolysulfide (average of 5 sulfur atoms per molecule and contained 37.3 weight % S) were added as solutions in n-hexane, diluted such that 1 ml/hour solution yielded 100 ppm sulfur.

All carbon monoxide suppressants were added, whether gas blends, neat liquids, or hexane solutions, such that the sulfur concentration was 100 ppm molar relative to total feed (ethane+steam).

The gas blends were metered in as standard for gas flow control. The liquids (both neat and hexane-diluted) were fed via a positive displacement pump and injected into the heated gas stream via a injector as disclosed in U.S. Pat. No. 5,435,904 (disclosure of which is incorporated herein by reference).

The laboratory cracking was then carried out by flowing steam (225 g/hr) and nitrogen (10 standard liter per minute (slm)) to the cracking coil while maintaining the furnace at 1300° F. A carbon monoxide suppressant described above was then introduced into the coil for treating the coil. As soon as treatment began, nitrogen gas flow was replaced with ethane gas flow (10 slm) and temperature ramping to furnace temperature of 1850° F. at 50° F. per minute was begun. Desired furnace temperature and severity (ethane conversion approximately 65–68%) reached in 12–15 minutes. These conditions were maintained for a total of 150 minutes (from initial ethane introduction). At all times the coil outlet pressure was maintained at 20 psia.

Immediately upon reaching the 150 minutes time limit, ethane and steam flow was replaced with helium and the furnace setpoint reduced to 1650° F. Helium purging (10 slm) of the coil was continued for at least 5 minutes.

A blank run was also conducted as above except that no carbon monoxide suppressant was introduced.

The coil was decoked and coke quantitation was accomplished by introduction of air (1.0 slm) to the flowing helium (10 slm) and quantifying the $CO_2$ produced by combustion of the coke deposits via gas chromatograph. Any CO produced is oxidized to $CO_2$ prior to quantitation.

Upon the completion of decoking, as determined by cessation of $CO_2$ production, the furnace temperature was reduced to 1300° F. in preparation for the next test.

Results shown in Table I are reported relative to those obtained with dimethylsulfide. Carbon monoxide maximum (|CO|max) is the maximum CO observed during the 150 minute cracking period. This typically occurred 15–20 minutes after ethane introduction, at or shortly after maximum temperature is reached. Carbon monoxide average (|CO|avg) is the average of all carbon monoxide readings throughout the 150 minute cracking period. Coke is the coke yield calculated from the carbon dioxide produced during the decoke. Overall is the arithmetic average of the carbon monoxide maximum, carbon monoxide average, and coke.

TABLE I

Suppression of CO and Coke*

| Suppressant | \|CO\|max | \|CO\|avg | Coke | Overall |
|---|---|---|---|---|
| None | 1.99 | 2.11 | 0.31 | 1.47 |
| Dimethylsulfide | 1.00 | 1.00 | 1.00 | 1.00 |
| Dimethyldisulfide | 0.99 | 0.98 | 0.97 | 0.98 |
| Diethylsulfide | 1.00 | 1.06 | 0.92 | 0.99 |
| Thiophene | 1.22 | 1.39 | 0.38 | 1.00 |
| Di-t-butylpolysulfide | 0.87 | 0.84 | 0.99 | 0.90 |
| Di-t-nonylpolysulfide | 1.05 | 0.61 | 0.73 | 0.80 |
| Di-t-nonylpolysulfide | 1.02 | 0.83 | 0.68 | 0.84 |

*The numbers in the table are normalized based on dimethylsulfide which is being used in the industry.

From these data, it is concluded that both polysulfides are effective substitutions for dimethylsulfide as CO suppressants. Perhaps the most interesting, and surprising, effect observed was the 27% reduction in coking for di-t-nonylpolysulfide relative to dimethyl sulfide. This was confirmed (32%) in a replicate run. This was the first demonstration of a reduced coke yield, with adequate CO control, for a sulfur compound.

The results shown in the above examples clearly demonstrate that the present invention is well adapted to carry out the objects and attain the end and advantages mentioned as well as those inherent therein. While modifications may be made by those skilled in the art, such modifications are encompassed within the spirit of the present invention as defined by the specification and the claims.

That which is claimed:

1. A process comprising contacting a cracking tube of a thermal cracking furnace, used in a thermal cracking process for converting a saturated hydrocarbon to an olefinic compound, with a fluid stream which comprises steam and a polysulfide in said cracking tube under conditions sufficient to effect the suppression of carbon monoxide formation during a thermal cracking process wherein said contacting is carried out before said saturated hydrocarbon is introduced into said cracking tube.

2. A process according to claim 1 wherein said polysulfide has the formula of $RS_qR$ wherein each R is independently a hydrocarbyl radical having 1 to about 30 carbon atoms and q is a number of about 3 to about 10.

3. A process according to claim 2 wherein said hydrocarbyl radical has 2 to 15 carbon atoms and q is a number from 3 to 6.

4. A process according to claim 1 wherein said polysulfide is selected from the group consisting of di-t-butylpolysulfide, di-t-nonylpolysulfide, and combinations thereof.

5. A process according to claim 1 wherein said saturated hydrocarbon is selected from ethane, propane, butane, pentane, naphtha, and combinations of two or more thereof.

6. A process according to claim 1 wherein said saturated hydrocarbon is ethane.

7. A process according to claim 1 wherein said saturated hydrocarbon is propane.

8. A process according to claim 1 wherein the weight ratio of said polysulfide to said steam in said fluid stream is in the range of from about 0.00002:1 to about 1:1.

9. A process according to claim 1 wherein the weight ratio of said polysulfide to said steam in said fluid stream is in the range of from 0.0005:1 to 0.5:1.

10. A process according to claim 1 wherein said fluid stream further comprises a hydrogen-containing fluid.

11. A process for reducing the formation of carbon monoxide or coke or both during a thermal cracking process comprising: (1) contacting a thermal cracking tube with a first fluid stream which comprises steam and a polysulfide under a condition sufficient to effect the generation of hydrogen sulfide in said cracking furnace; and (2) introducing a second fluid stream which comprises steam, a saturated hydrocarbon, and a polysulfide into said thermal cracking furnace under a condition sufficient to effect the conversion of said saturated hydrocarbon to a product stream which comprises an olefinic compound.

12. A process according to claim 11 wherein said polysulfide in step (1) has the formula of $RS_qR$ wherein each R is independently a hydrocarbyl radical having 1 to about 30 carbon atoms and q is a number of about 3 to about 10.

13. A process according to claim 12 wherein said hydrocarbyl radical has 2 to 15 carbon atoms and q is a number from 3 to 6.

14. A process according to claim 11 wherein said polysulfide in step (1) is selected from the group consisting of di-t-butylpolysulfide, di-t-nonylpolysulfide, and combinations thereof.

15. A process according to claim 11 wherein said saturated hydrocarbon is selected from ethane, propane, butane, pentane, naphtha, and combinations of two or more thereof.

16. A process according to claim 11 wherein said saturated hydrocarbon is ethane.

17. A process according to claim 11 wherein said saturated hydrocarbon is propane.

18. A process according to step (1) of claim 11 wherein the weight ratio of said polysulfide to said steam in said fluid stream is in the range of from about 0.00002:1 to about 1:1.

19. A process according to step (1) of claim 11 wherein the weight ratio of said polysulfide to said steam in said fluid stream is in the range of from 0.0005:1 to 0.5:1.

20. A process according to step (2) of claim 11 wherein said polysulfide has the formula of $RS_qR$ wherein each R is independently a hydrocarbyl radical having 1 to about 30 carbon atoms and q is a number of about 3 to about 10.

21. A process according to claim 20 wherein said hydrocarbyl radical has 2 to 15 carbon atoms and q is a number from 3 to 6.

22. A process according to step (2) of claim 11 wherein said polysulfide is selected from the group consisting of di-t-butylpolysulfide, di-t-nonylpolysulfide, and combinations thereof.

23. A process according to step (2) of claim 11 wherein the weight ratio of said polysulfide to said stream in said fluid stream is in the range of from about 0.00002:1 to about 1:1.

24. A process according to step (2) of claim 11 wherein the weight ratio of said polysulfide to said steam in said fluid stream is in the range of from 0.0005:1 to 0.5:1.

25. A process according to claim 11 wherein said fluid stream further comprises a hydrogen-containing fluid.

26. A thermal cracking process for converting ethane to ethylene comprising: (1) contacting a cracking tube with a first fluid stream which comprises steam and a polysulfide at a temperature in the range of from about 1000 ° F. to 2000° F. and under a pressure in the range of from about 1 psig to about 100 psig; and thereafter (2) introducing a second fluid which comprises steam, said polysulfide, and ethane into said cracking tube wherein said polysulfide is selected from the group consisting of di-t-butylpolysulfide, di-t-nonylpolysulfide, and combinations thereof.

27. A process according to claim 26 wherein said polysulfide is di-t-nonylpolysulfide having an average of 5 sulfur atoms per molecule.

28. A thermal cracking process for converting propane to propylene comprising: (1) contacting a cracking tube with a first fluid stream which comprises steam and a polysulfide at a temperature in the range of from about 1000° F. to 2000° F. and under a pressure in the range of from about 1 psig to about 100 psig; and thereafter (2) introducing a second fluid which comprises steam, said polysulfide, and propane into said cracking tube wherein said polysulfide is selected from the group consisting of di-t-butylpolysulfide, di-t-nonylpolysulfide, and combinations thereof.

29. A process according to claim 28 wherein said polysulfide is di-t-nonylpolysulfide having an average of 5 sulfur atoms per molecule.

* * * * *